US012012713B2

(12) United States Patent
Yuan

(10) Patent No.: US 12,012,713 B2
(45) Date of Patent: Jun. 18, 2024

(54) MONITORING DEVICE AND WELL COVER ASSEMBLY

(71) Applicants: Zhengzhou Wanmayun Electronic Technology CO., Ltd., Zhengzhou (CN); HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventor: Bo-Duo Yuan, Shenzhen (CN)

(73) Assignees: Zhengzhou Wanmayon Electronic Technology CO., Ltd., Zhengzhou (CN); HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 18/224,624

(22) Filed: Jul. 21, 2023

(65) Prior Publication Data

US 2024/0044098 A1 Feb. 8, 2024

(30) Foreign Application Priority Data

Aug. 4, 2022 (CN) ..... 202222045104.7

(51) Int. Cl.
*E21B 41/00* (2006.01)
*E02D 29/14* (2006.01)

(52) U.S. Cl.
CPC ..... *E02D 29/1481* (2013.01)

(58) Field of Classification Search
CPC ..... E21B 41/0021; E02D 29/1481
See application file for complete search history.

(56) References Cited

U.S. PATENT DOCUMENTS 5,664,626 A * 9/1997 Watts, III ..... E21B 33/02 166/93.1
7,571,764 B1 * 8/2009 Sammann ..... E21B 19/10 166/94.1

(Continued)

FOREIGN PATENT DOCUMENTS

CN 105160781 A * 12/2015
CN 109487831 A * 3/2019 ..... E02D 29/14

(Continued)

*Primary Examiner* — Matthew R Buck
(74) *Attorney, Agent, or Firm* — ScienBiziP, P.C.

(57) ABSTRACT

A well cover assembly includes a monitoring device and a well cover. The well cover includes a first protrusion and a second protrusion. A through hole is defined on the well cover and surrounded by the second protrusion. The monitoring device can be installed on the well cover. The monitoring device includes a monitoring terminal and a fixing bracket. The fixing bracket includes a first bracket and a second bracket. One end of the first bracket is fixed to the monitoring terminal, and another end can protrude from the through hole. The second bracket is connected to the end of the first bracket protruding from the through hole, the second bracket can extend from the end of the first bracket toward an edge of the second protrusion and toward the first protrusion. The second bracket further can clamp with each of the second protrusion and the first protrusion.

18 Claims, 5 Drawing Sheets

(56) References Cited

U.S. PATENT DOCUMENTS

| | | | | |
|---|---|---|---|---|
| 9,790,758 | B2 * | 10/2017 | Dugas | E21B 33/03 |
| 2023/0287648 | A1 * | 9/2023 | Nunnery | E02D 29/1472 |

FOREIGN PATENT DOCUMENTS

| | | | | | |
|---|---|---|---|---|---|
| CN | 111997558 | A | * | 11/2020 | E21B 33/03 |
| CN | 112185088 | A | * | 1/2021 | |
| CN | 113356273 | A | * | 9/2021 | |
| CN | 114525814 | A | * | 5/2022 | |
| CN | 217240699 | U | * | 8/2022 | |
| CN | 217520515 | U | * | 9/2022 | |
| GB | 2580600 | A | * | 7/2020 | E21B 33/03 |

* cited by examiner

MONITORING DEVICE AND WELL COVER ASSEMBLY

FIELD

The subject matter herein generally relates to well cover monitoring, and more particularly, to a monitoring device for mounting on a well cover and a well cover assembly including the monitoring device.

BACKGROUND

When the well cover is installed on a pipeline, a monitoring device is needed to monitor a position of the well cover or the environment in the pipeline. To install the monitoring device on the well cover, holes are defined on the well cover, and then the monitoring device is installed in the holes by bolts. However, the above installation manner has high cost and low efficiency. Therefore, there is room for improvement in the art.

BRIEF DESCRIPTION OF THE DRAWINGS

Implementations of the present technology will now be described, by way of example only, with reference to the attached figures.

DETAILED DESCRIPTION

Figure 1:
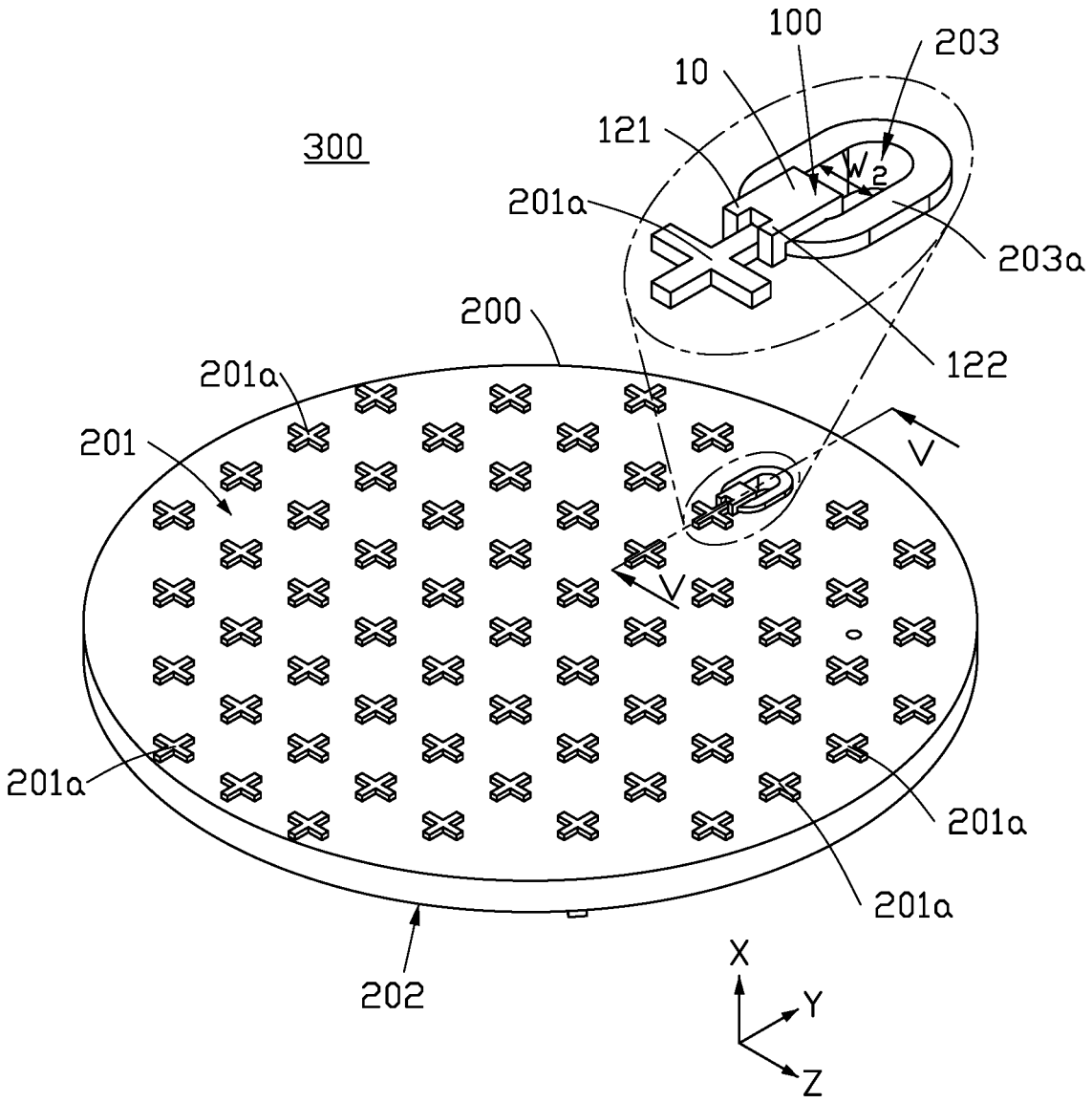
FIG. 1 is a diagrammatic view of an embodiment of a monitoring device installed on a well cover according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

Some embodiments of the present disclosure will be described in detail with reference to the drawings. If no conflict, the following embodiments and features in the embodiments can be combined with each other.

Referring to FIG. 1, a well cover assembly 300 including a monitoring device 100 and a well cover 200 is provided according to an embodiment of the present disclosure. The monitoring device 100 is configured to be installed on the well cover 200. The well cover 200 can cover a pipeline (not shown), and the monitoring device 100 can monitor a position of the well cover 200 or an environment in the pipeline. The well cover 200 includes a first surface 201 and a second surface 202 opposite to the first surface 201 along a first direction X. When the well cover 200 is in use, the first surface 201 faces an external environment, and the second surface 202 faces the pipeline.

A through hole 203 is defined on the well cover 200, and passes through the first surface 201 and the second surface 202. The monitoring device 100 is disposed on the second surface 202 of the well cover 200 and extends toward the first surface 201 through the through hole 203. A plurality of first protrusions 201*a* and a second protrusion 203*a* are disposed on the first surface 201. The through hole 203 is surrounded by the second protrusion 203*a*. The through hole 203 is formed during the production process of the well cover 200, which is convenient for disassembling the well cover 200.

Figure 2:
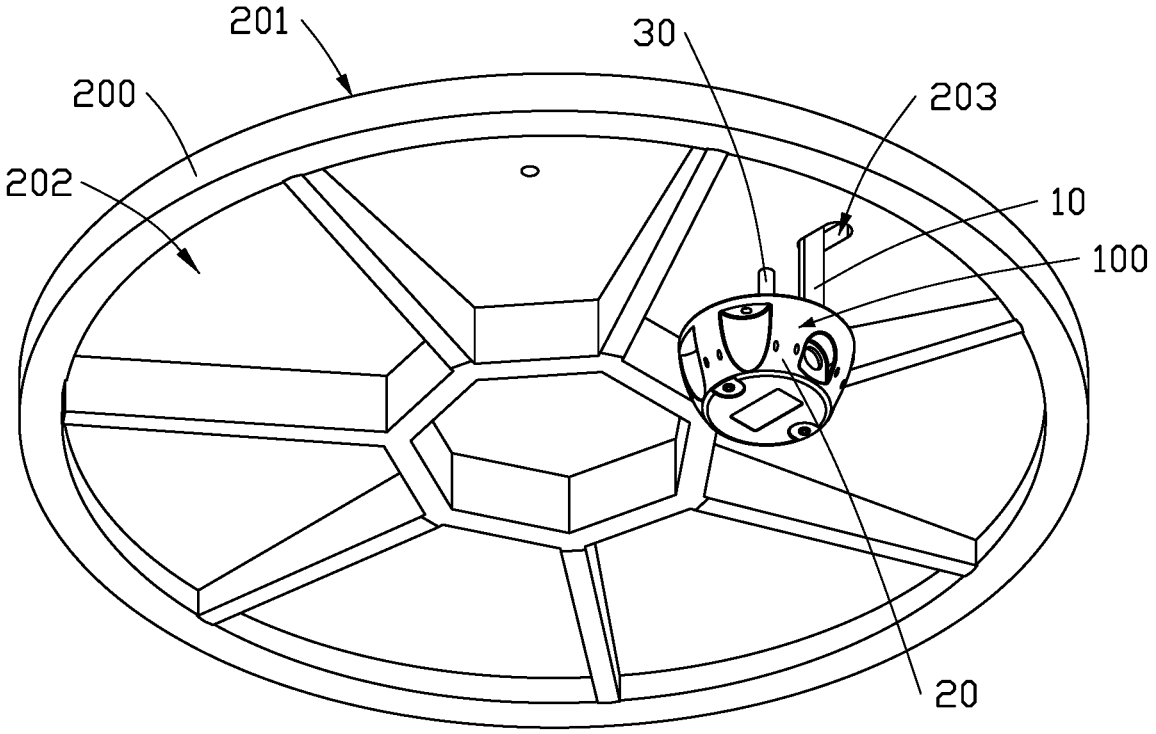
FIG. 2 is similar to FIG. 1, but showing the monitoring device and the well cover from another angle.

Referring to FIGS. 1 and 2, the monitoring device 100 includes a fixing bracket 10 and a monitoring terminal 20. A portion of the fixing bracket 10 is disposed on the second surface 202 of the well cover 200, and a remaining portion of the fixing bracket 10 passes through the through hole 203 and is disposed on the first surface 201 of the well cover 200. The fixing bracket 10 is clamped with the second protrusion 203*a* and one of the plurality of first protrusions 201*a*. The monitoring terminal 20 is also disposed on the second surface 202 of the well cover 200, and is fixed to the fixing bracket 10.

Figure 3:
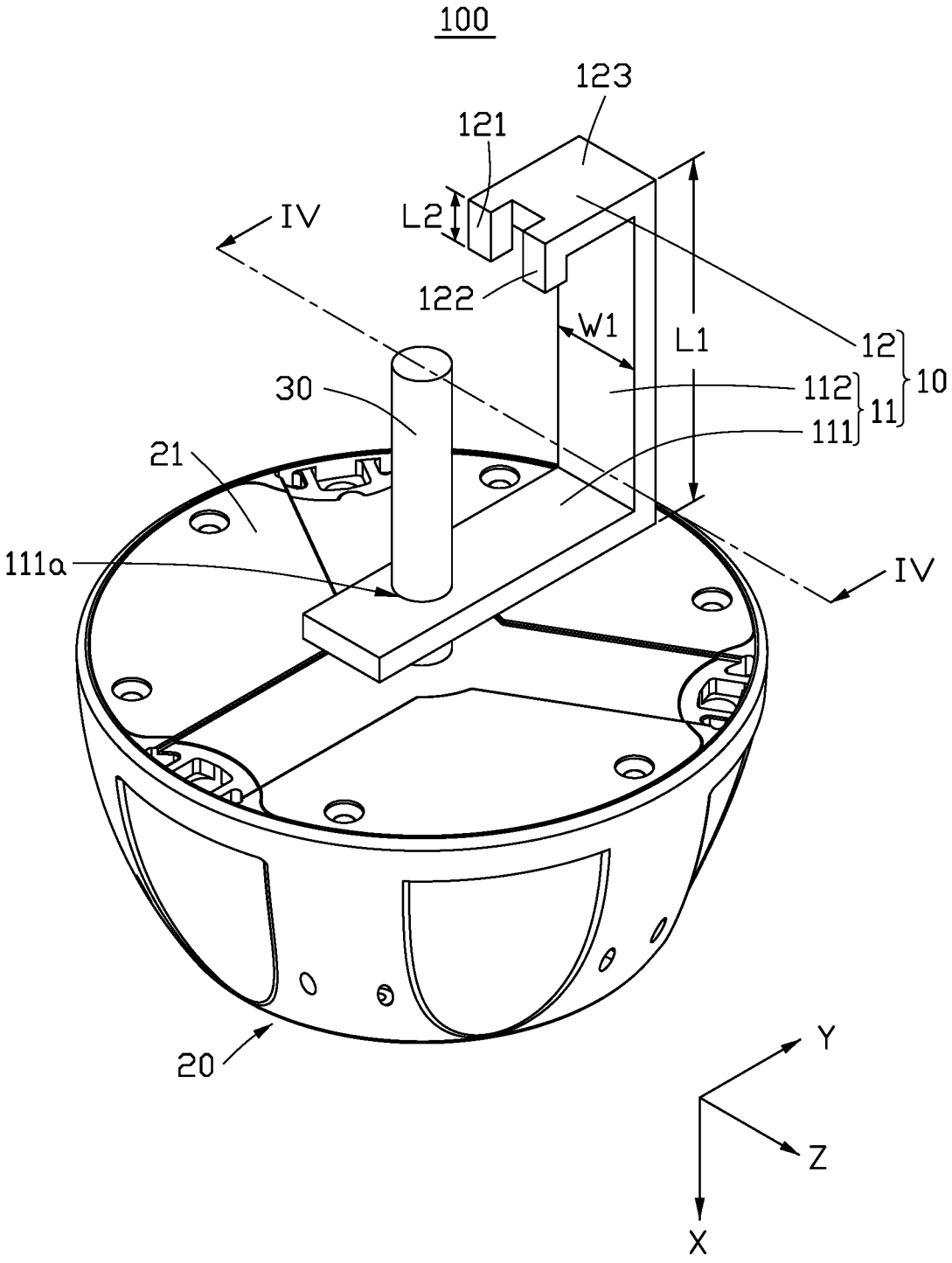
FIG. 3 is a diagrammatic view of the monitoring device of FIG. 1.

Referring to FIG. 3, the fixing bracket 10 includes a first bracket 11 and a second bracket 12. One end of the first bracket 11 is fixed to the monitoring terminal 20, and another end of the first bracket 11 can protrude from the through hole 203. The second bracket 12 is connected to the end of the first bracket 11 protruding from the through hole 203. The second bracket 12 extends from the end of the first bracket 11 toward an edge of the second protrusion 203*a* and is clamped with the second protrusion 203*a*, and further extends toward the first protrusion 201*a* and is clamped with the first protrusion 201*a*. The fixing bracket 10 can be U-shaped.

In some embodiments, the first bracket 11 includes a first connecting plate 111 and a second connecting plate 112. A length direction of the first connecting plate 111 extends along a second direction Y, a length direction of the second connecting plate 112 extends along the first direction X, and the second direction Y is perpendicular to the first direction X. One end of the second connecting plate 112 is fixed to the first connecting plate 111, and another end of the second connecting plate 112 extends along the first direction X and protrudes from the through hole 203 to connect to the second bracket 12.

The second bracket 12 includes a first clamping portion 121, a second clamping portion 122, and a connecting portion 123. The connecting portion 123 is disposed on an end of the second bracket 12 away from the first bracket 11 and extends along the second direction Y. The connecting portion 123 and the first connecting plate 111 are disposed on a same side of the second connecting plate 112. The first clamping portion 121 and the second clamping portion 122 are spaced from each other along a third direction Z. The third direction Z is perpendicular to the first direction X and the second direction Y. Both the first clamping portion 121 and the second clamping portion 122 are connected to the connecting portion 123 and extend toward the first connecting plate 111. The second connecting plate 112, the connecting portion 123, the first clamping portion 121, and the second clamping portion 122 jointly form a hook. When the fixing bracket 10 is connected to the well cover 200, the second clamping portion 122 passes through the through hole 203, and the connecting portion 123 is in contact with a surface of the second protrusion 203*a*. The first protrusion 201*a* is held between the first clamping portion 121 and the second clamping portion 122. Both the first clamping portion 121 and the second clamping portion 122 are in contact with a side of the second protrusion 203*a* facing the first protrusion 201*a*. The fixing bracket 10 is fixed to the well cover 200 by the structure of the well cover 200 itself.

In some embodiments, the first clamping portion 121 and the second clamping portion 122 are clamped on one of the first protrusions 201*a* closest to the second protrusion 203*a*, thereby reducing a length of the connecting portion 123 on the first surface 201. Thus, an area of the second bracket 12 exposed from the first surface 201 is reduced, thereby preventing damages to the second bracket 12 (for example, damages caused by wheels travelling through the well cover 200).

A width W1 of the second connecting plate 112 along the third direction Z is less than or equal to a width W2 of the through hole 203 along the third direction Z. That is, second connecting plate 112 and an inner wall of the through hole 203 can be spaced from each other or in contact with each other.

A length L1 of the second connecting plate 112 along the first direction X is greater than a length L2 of the first clamping portion 121 or a length L2 of the second clamping portion 122 along the first direction X, so that the second bracket 12 can pass through the through hole 203 and the fixing bracket 10 is conveniently installed on the well cover 200.

Figure 4:
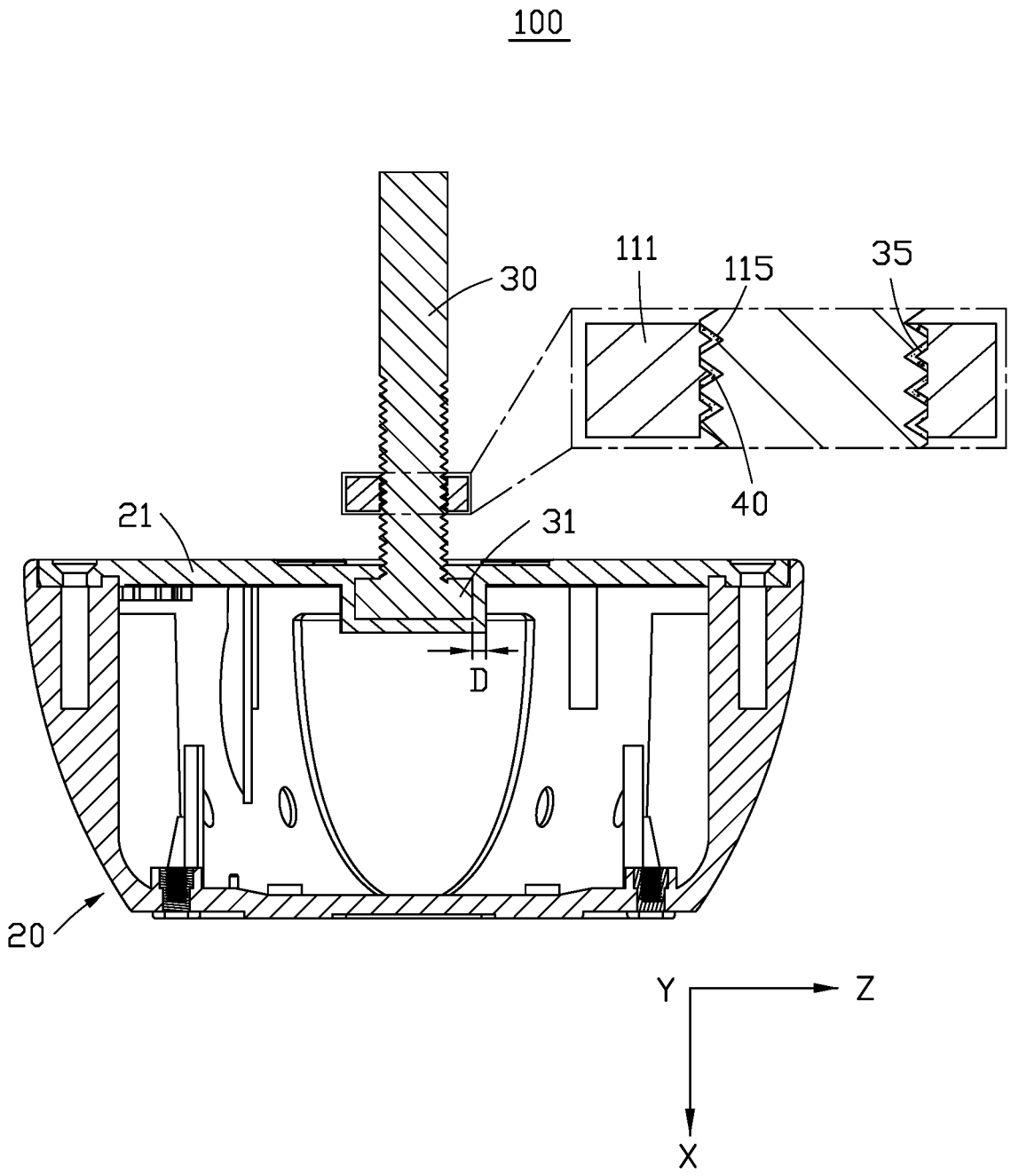
FIG. 4 is a cross-sectional view taken along line IV-IV of FIG. 3.

Referring to FIGS. 3 and 4, in some embodiments, the monitoring device 100 further includes a connecting rod 30. The connecting rod 30 connects the monitoring terminal 20 and the first connecting plate 111, thereby fixing the monitoring terminal 20 to the first bracket 11. In one embodiment, a connecting hole 111*a* is defined on the first connecting plate 111. An external thread 35 is defined on the connecting rod 30, an internal thread 115 engaged with the external thread 35 is defined on the connecting hole 111*a*. The connecting rod 30 is engaged with the connecting hole 111*a* through the external thread 35 and the internal thread 115.

The monitoring terminal 20 includes a housing 21 and a monitor (not shown) disposed in the housing 21. The monitor communicates with an electronic terminal, such as a mobile phone or a computer. The monitor can monitor a position of the well cover 200, a water level in a sewer, or abnormal gas, etc., and transmit the corresponding monitoring information to the electronic terminal. When the well cover 200 moves or tilts at a large angle, the water level exceeds the monitoring position, or abnormal gas is detected, the electronic terminal will send out an alarm according to the corresponding monitoring information of the monitor.

A third protrusion 31 is disposed at an end of the connecting rod 30 and extends from a periphery of the connecting rod 30. The housing 21 can be wrapped around the third protrusion 31 by injection molding, so that the third protrusion 31 is fixed in the housing 21. In some embodiments, the housing 21 covers the third protrusion 31 with a thickness D of at least 2 mm, so as to increase a connection strength between the connecting rod 30 and the housing 21.

Figure 5:
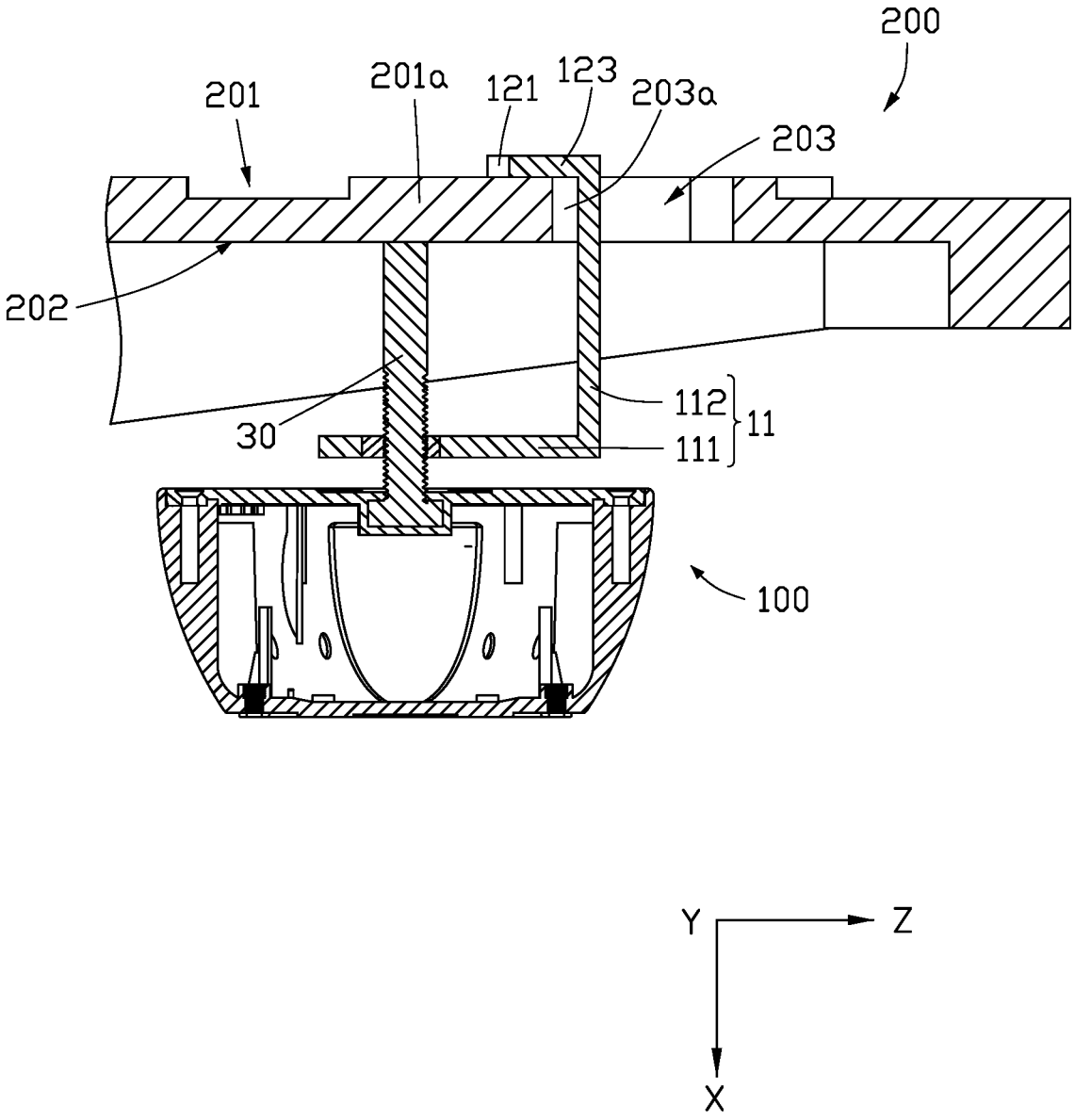
FIG. 5 is a cross-sectional view taken along line V-V of FIG. 1.

Referring to FIG. 5, when the monitoring device 100 needs to be fixed on the well cover 200, a distance between the connecting rod 30 and the well cover 200 can be adjusted by threads, so that an end of the connecting rod 30 away from the third protrusion 31 abuts against the second surface 202 of the well cover 200. By the connecting rod 30 abutting against the second surface 202, a stability of the connection of the fixing bracket 10 to the well cover 200 is increased.

In some embodiments, an adhesive layer 40 is disposed on a surface of the external thread 35 and/or a surface of the internal thread 115. When the connecting rod 30 extends through the connecting hole 111*a*, the adhesive layer 40 is disposed between the connecting hole 111*a* and the connecting rod 30 to prevent the connecting rod 30 from separating from the connecting hole 111*a* under a long-term vibration, thereby preventing damages to the monitoring terminal 20.

When installing the monitoring device 100 on the well cover 200, the second bracket 12 is extended through the through hole 203 and clamped with the second protrusion 203*a*. The first clamping portion 121 and the second clamping portion 122 are clamped with the first protrusion 201*a*, and then the monitoring terminal 20 is fixed to the well cover 200. Through the cooperation between the fixing bracket 10 and the well cover 200, no additional holes need to be defined on the well cover 200, which saves installation time and labor costs and improves installation efficiency.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A monitoring device configured to be installed on a well cover, the well cover comprising a first protrusion and a second protrusion protruding from a same surface of the well cover, a through hole being defined on the well cover and surrounded by the second protrusion; the monitoring device comprising:

a monitoring terminal; and a fixing bracket connected to the monitoring terminal, the fixing bracket comprising:

a first bracket, one end of the first bracket fixed to the monitoring terminal, and another end of the first bracket configured to protrude from the through hole; and a second bracket connected to the end of the first bracket protruding from the through hole, the second bracket configured to extend from the end of the first bracket toward an edge of the second protrusion and toward the first protrusion, the second bracket further configured to clamp with each of the second protrusion and the first protrusion.

2. The monitoring device of claim 1, wherein the first bracket comprises a first connecting plate and a second connecting plate, the second connecting plate extends along a first direction and connects the second bracket, the first connecting plate extends along a second direction and connects to the second connecting plate, and the second direction is perpendicular to the first direction.

3. The monitoring device of claim 2, wherein the second bracket comprises a first clamping portion, a second clamping portion, and a connecting portion; the connecting portion is connected to one end of the second connecting plate away from the first connecting plate, both the first clamping portion and the second clamping portion are connected to the connecting portion away from the second connecting plate, the first clamping portion and the second clamping portion are spaced from each other along a third direction and configured to clamp with the first protrusion, both the first clamping portion and the second clamping portion are further configured to clamp with the second protrusion, and the third direction is perpendicular to the first direction and the second direction.

4. The monitoring device of claim 3, wherein a length of the second connecting plate along the first direction is greater than a length of the first clamping portion or a length of the second clamping portion along the first direction.

5. The monitoring device of claim 3, wherein a width of the second connecting plate along the third direction is less than or equal to a width of the through hole along the third direction.

6. The monitoring device of claim 1, further comprising a connecting rod, wherein the connecting rod is fixed to the monitoring terminal; an external thread is defined on the connecting rod; a connecting hole is defined on the first bracket, an internal thread engaged with the external thread is defined on the connecting hole, the connecting rod is connected to the connecting hole through the internal thread and the external thread, and an end of the connecting rod away from the monitoring terminal is configured to be in contact with the well cover.

7. The monitoring device of claim 6, wherein the monitoring terminal comprises a housing, the connecting rod connects the first bracket and the housing, a third protrusion is disposed at an end of the connecting rod, and the housing covers the third protrusion.

8. The monitoring device of claim 7, wherein a thickness of the housing covering the third protrusion is at least 2 mm.

9. The monitoring device of claim 6, further comprises an adhesive layer disposed between the connecting hole and the connecting rod.

10. A well cover assembly, comprising:

a well cover comprising a first protrusion and a second protrusion protruding from a same surface of the well cover, a through hole being defined on the well cover and surrounded by the second protrusion; and a monitoring device configured to be installed on the well cover, the monitoring device comprising:

a monitoring terminal;

a fixing bracket connected to the monitoring terminal, the fixing bracket comprising:

a first bracket, one end of the first bracket fixed to the monitoring terminal, and another end of the first bracket configured to protrude from the through hole; and a second bracket connected to the end of the first bracket protruding from the through hole, the second bracket configured to extend from the end of the first bracket toward an edge of the second protrusion and toward the first protrusion, the second bracket further configured to clamp with each of the second protrusion and the first protrusion.

11. The well cover assembly of claim 10, wherein the first bracket comprises a first connecting plate and a second connecting plate, the second connecting plate extends along a first direction and connects the second bracket, the first connecting plate extends along a second direction and connects to the second connecting plate, and the second direction is perpendicular to the first direction.

12. The well cover assembly of claim 11, wherein the second bracket comprises a first clamping portion, a second clamping portion, and a connecting portion; the connecting portion is connected to one end of the second connecting plate away from the first connecting plate, both the first clamping portion and the second clamping portion are connected to the connecting portion away from the second connecting plate, the first clamping portion and the second clamping portion are spaced from each other along a third direction and configured to clamp with the first protrusion, both the first clamping portion and the second clamping portion are further configured to clamp with the second protrusion, and the third direction is perpendicular to the first direction and the second direction.

13. The well cover assembly of claim 12, wherein a length of the second connecting plate along the first direction is greater than a length of the first clamping portion or a length of the second clamping portion along the first direction.

14. The well cover assembly of claim 12, wherein a width of the second connecting plate along the third direction is less than or equal to a width of the through hole along the third direction.

15. The well cover assembly of claim 10, further comprising a connecting rod, wherein the connecting rod is fixed to the monitoring terminal; an external thread is defined on the connecting rod; a connecting hole is defined on the first bracket, an internal thread engaged with the external thread is defined on the connecting hole, the connecting rod is connected to the connecting hole through the internal thread and the external thread, and an end of the connecting rod away from the monitoring terminal is configured to be in contact with the well cover.

16. The well cover assembly of claim 15, wherein the monitoring terminal comprises a housing, the connecting rod connects the first bracket and the housing, a third protrusion is disposed at an end of the connecting rod, and the housing covers the third protrusion.

17. The well cover assembly of claim 16, wherein a thickness of the housing covering the third protrusion is at least 2 mm.

18. The well cover assembly of claim 15, further comprises an adhesive layer disposed between the connecting hole and the connecting rod.

* * * * *